US005509577A

United States Patent [19]

Benson

[11] Patent Number: 5,509,577

[45] Date of Patent: Apr. 23, 1996

[54] FLUID STORAGE AND DISPENSING SYSTEM

[75] Inventor: Robert D. Benson, White Bear Lake, Minn.

[73] Assignee: Core Incorporated, White Bear Lake, Minn.

[21] Appl. No.: 235,866

[22] Filed: May 2, 1994

[51] Int. Cl.[6] ..... B67D 5/08

[52] U.S. Cl. ..... 222/61; 206/511; 220/23.83; 222/63; 222/130; 222/143; 222/333; 222/638; 222/189.11

[58] Field of Search ..... 222/130, 143, 222/189, 333, 638, 71, 63, 189.06, 189.11, 61; 206/509, 511, 512; 220/23.6, 23.83, 23.86

[56] References Cited

U.S. PATENT DOCUMENTS

| | | | |
|---|---|---|---|
| 1,436,056 | 11/1922 | Sherwood | 222/628 |
| 1,646,477 | 10/1927 | Davis et al. | 222/628 |
| 1,694,624 | 12/1928 | Piquerez . | |
| 2,461,197 | 2/1949 | Chambers | 62/89 |
| 2,894,541 | 7/1959 | Marban | 141/30 |
| 3,101,102 | 8/1963 | Gearhart et al. | 141/209 |
| 3,129,836 | 4/1964 | Frevel | 220/1 |
| 3,407,961 | 10/1968 | Box | 206/511 |
| 3,563,409 | 2/1971 | Gray | 206/512 X |
| 3,863,688 | 2/1975 | Millar et al. | 141/59 |
| 3,946,894 | 3/1976 | Simkus | 220/256 |
| 3,958,719 | 5/1976 | Ward | 220/288 |
| 4,154,367 | 5/1979 | Hanson et al. | 222/130 |
| 4,398,653 | 8/1983 | Daloisio | 206/512 X |
| 4,815,591 | 3/1989 | Tivy | 220/23.6 X |
| 4,819,833 | 4/1989 | Huddleston et al. | 222/130 X |
| 4,972,972 | 11/1990 | Goguen | 222/130 |
| 5,085,346 | 2/1992 | Wright | 222/143 |
| 5,105,858 | 4/1992 | Levinson | 206/511 X |

OTHER PUBLICATIONS

Advertising piece of Malabar International, date unknown but before 1993.

Excerpt from Jan. 07, 1991 report of Robert D. Benson (present applicant) to Northwest Airlines, showing hand pump cart in use over one year before present application filed.

*Primary Examiner*—Kevin P. Shaver

*Attorney, Agent, or Firm*—Richard E. Brink

[57] ABSTRACT

A medium-sized portable container for holding and dispensing such fluids as aircraft engine oil is formed from durable, corrosion-resistant polymeric material such as high density polyethylene. The container, which has a generally rectangularly parallelepipedal shape, is positioned with its longest dimension parallel to the ground to enhance stability and permit stacking. The container is divided into two compartments, one holding the fluid to be dispensed and the other enclosing an electrically driven pump and other dispensing equipment. Controls are provided to shut off current flow automatically when the dispensing pump is not operating.

14 Claims, 4 Drawing Sheets

FLUID STORAGE AND DISPENSING SYSTEM

BACKGROUND OF THE INVENTION

This invention relates to systems for containing and dispensing fluids and is particularly concerned with portable containers for fluid used in servicing aircraft, e.g., hydraulic fluids and engine oil.

Portable containers for hydraulic fluids or engine oil, which may be of 5-gallon, 25-gallon, or even 55-gallon size, are typically filled from either 55-gallon drums or "totes," which are stationary 260–360-gallon containers mounted on a pallet, Five-gallon containers filled with fluid are commonly either mounted on or integral with carts and wheeled to an airplane for routine servicing, where they dispense hydraulic fluid or engine oil via a hand pump to the specific aircraft systems using such fluids. These containers may be made of stainless steel or durable polymers, a preferred container of the latter type being described and claimed in applicant's concurrently filed patent application Ser. No. 6/236,199 (Attorney Docket No. 9309).

When an airplane is to be reconditioned after a predetermined number of hours of service, the various fluids are completely drained and replaced. Heretofore, large 55-gallon metal containers, permanently mounted on a lift truck, have been driven to the aircraft, typically located in a hangar, where current from the truck battery was used to drive a pump that dispensed fluid (especially engine oil) from the container to the appropriate system on the aircraft. This container is subject to contamination with both dirt and water, condensation often occurring in the container during humid weather. Both dirt and water cause serious damage to the hydraulic and lubricating systems on aircraft, dirt for obvious reasons and water because of reaction with the phosphate esters in synthetic fluids to yield a highly acidic and corrosive product. Further, because of the unitary construction, damage to the container has required removing both the container and the truck from service. At least one airline has also used a 25-gallon cylindrical plastic container, protectively surrounded by a metal shell on which various fittings, meters, etc., were installed, as a portable unit from which fluids were dispensed. This unit has been carried by both lift trucks and pickup trucks, electrical power being supplied from the truck battery to a pump for dispensing the fluid. The metal shell adds weight, and this unit is also susceptible to contamination by particulate matter and water.

BRIEF SUMMARY

The present invention provides, for the first time, it is believed, a container that not only holds as much fluid as the previously mentioned 25-gallon cylindrical container but also is compact, light weight, and when placed on a lift truck or in a pickup truck, readily moved to a desired location. This container, which resists contamination of the contents with moisture or particulate matter, incorporates an electrically driven pump for dispensing hydraulic fluids. The pump ceases to draw current when dispensing has been discontinued, thereby keeping the truck battery from discharging.

The invention provides a durable, corrosion-resistant, preferably recyclable polymeric container that is generally rectangularly parallepipedal in shape, the longest dimension of the container extending parallel to the ground to enhance stability, and one side being preferably contoured to present an angular surface on which controls are mounted. The container is divided into two compartments, one holding fluid to be dispensed and the other enclosing electrically operated dispensing equipment. The fiat bottom and top of the container permit stacking with other containers of the same type, the preferable incorporation of mating protuberances on the top of a first container and recesses on the bottom of a second container enhancing stability. A number of other features are included in the invention, as will be apparent from the description that follows.

BRIEF DESCRIPTION OF THE DRAWING

Understanding of the invention will be enhanced by referring to the accompanying drawing, in which like numbers refer to like parts in the several views, and in which.

DETAILED DESCRIPTION

Understanding of the invention will be further enhanced by referring to the following description of a currently preferred but nonlimiting embodiment.

Figure 1:
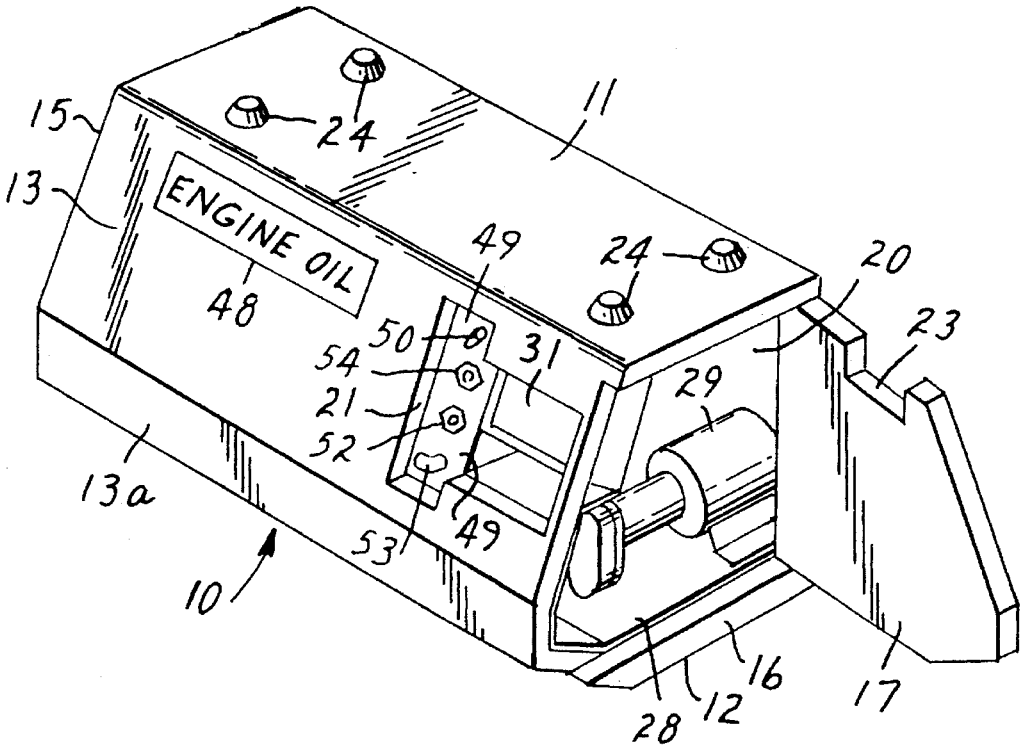
FIG. 1 is a perspective view of the container of the invention, with the end door opened to give a general view of the control compartment.
Figure 2:
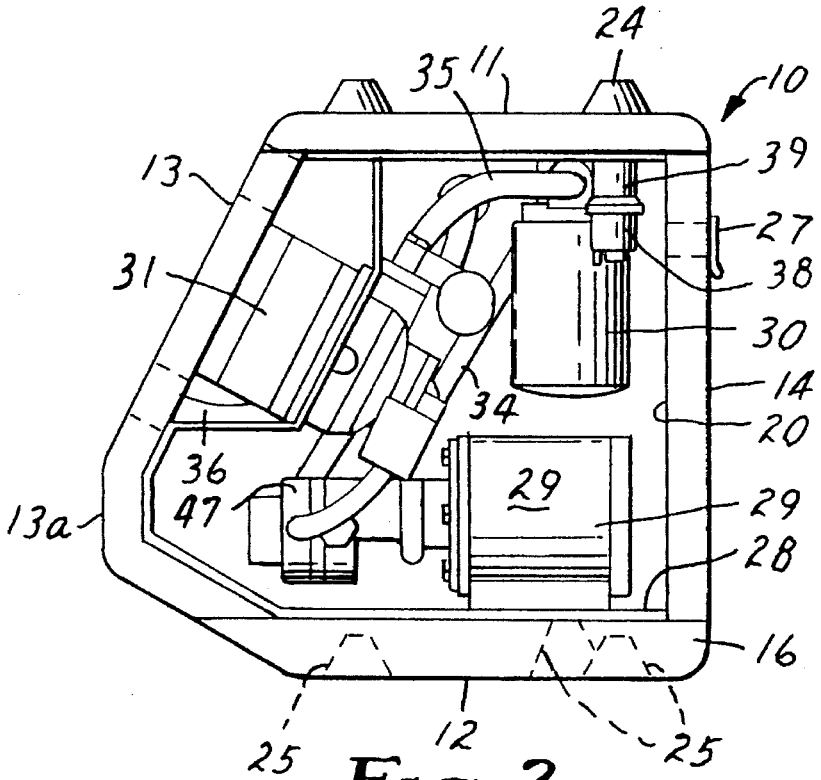
FIG. 2 is an elevation view of the right end of the container with the door removed, showing the control compartment and the plumbing utilized in dispensing oil but with all electrical circuitry removed to simplify understanding.
Figure 3:
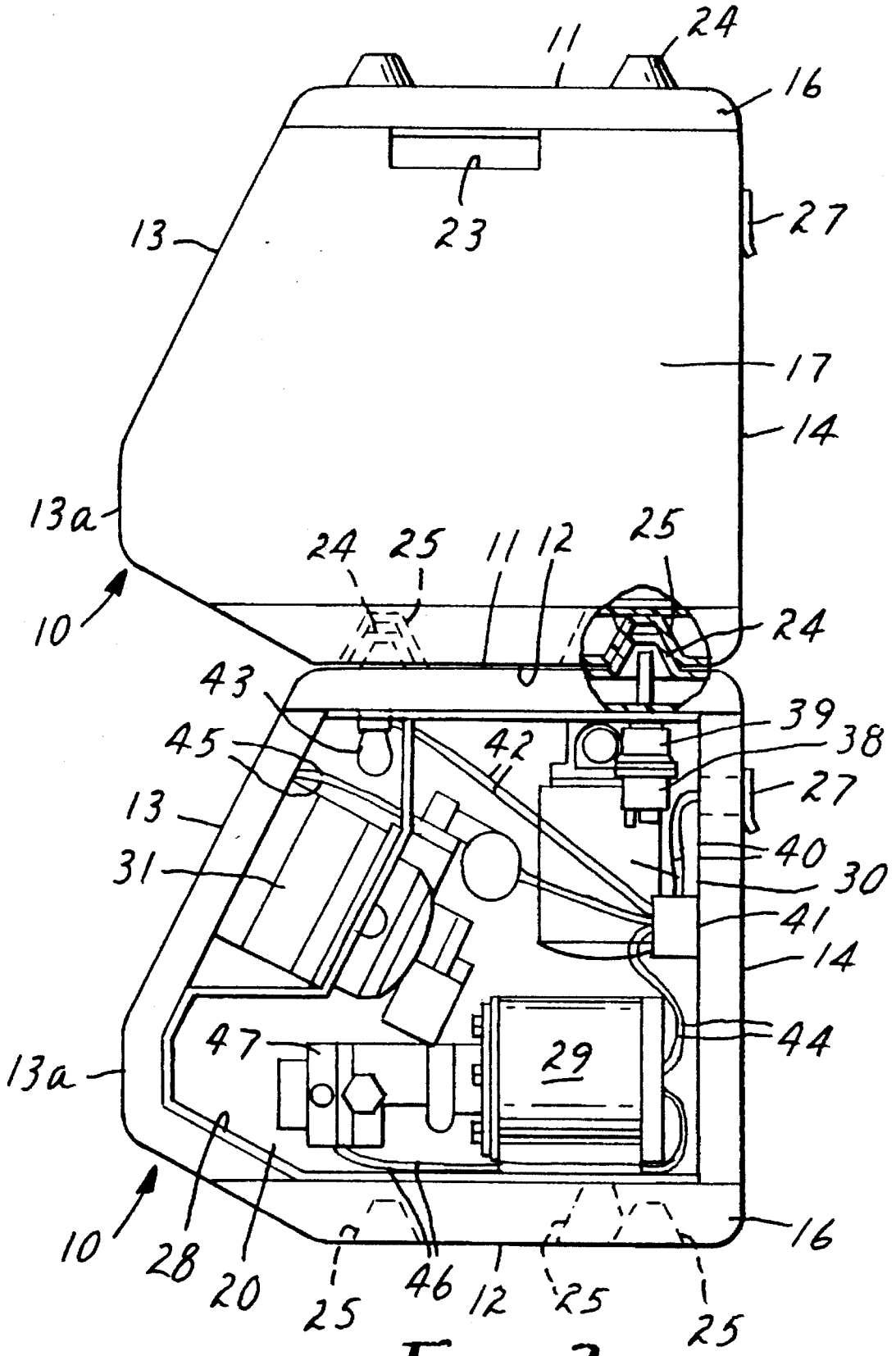
FIG. 3 is an elevation view of the right end of two stacked containers of the invention, partially in cross section to facilitate understanding, the door on the lower container being removed, showing the control compartment and the electrical circuitry for operating the dispenser, but with all plumbing removed, again to facilitate understanding.

First considering FIG. 1, container 10 comprises top panel 11, bottom panel 12, upper front panel 13, lower front panel **13*a*, back panel 14, left end 15, and right end 16. Container 10 is internally subdivided by inner wall 18 into fluid compartment 19 and control compartment 20, the latter being normally concealed by door 17. Left end 15 is provided with an indented portion that serves as a first hand hold, door 17 being provided with cut out portion 22 to provide a second hand hold, so that container 10 can be more easily picked up and moved to a desired location. Upper front panel 13 is provided with opening 18, into which various controls are positioned, as is shown more clearly in FIGS. 5 and 6. Extending upwardly from top panel 11 are protuberances 24, and extending inwardly into bottom panel 12 are complementarily shaped and located recesses 25. As is shown in FIG. 3, these complementary protuberances 24 and recesses 25 provide for stability when a plurality of containers 10 are stacked on top of each other. Turning now to FIGS. 2, 3, and 6, it will be seen that the various items of fluid pumping equipment are mounted on chassis 28, control panel 49 and meter 31** being located at the forward end.

Chassis 28 is formed from a sheet of folded metal having a single strap connecting the upper and lower portions. Located in the upper portion of chassis 28 are holes 56, through which screws are inserted into threaded female inserts (not shown) to attach chassis 28 to the upper inside portion of compartment 20. For the same purpose, holes 58 are provided, through which screws are inserted to attach the bottom of chassis 28 to the bottom of compartment 20, threaded female inserts 37 in the bottom of compartment 20 receiving the screws. It will be apparent that, if desired, the dispensing equipment could be mounted directly in control compartment 20, eliminating chassis 28.

Figure 4:
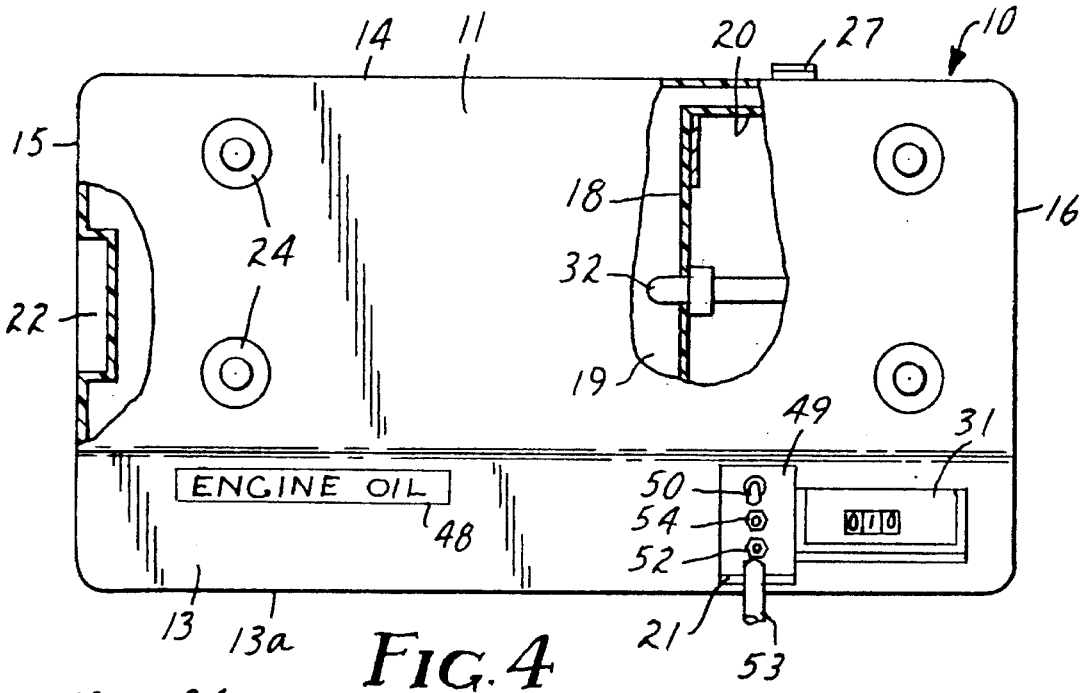
FIG. 4 is a top view of the container, also partially broken away to indicate constructional details.
Figure 5:
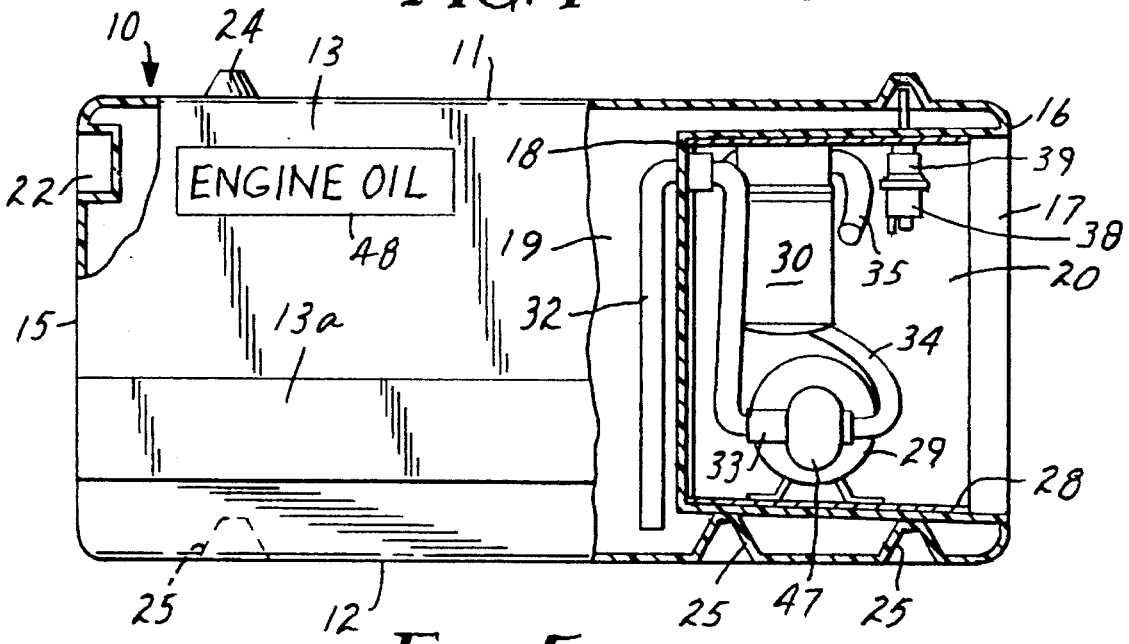
FIG. 5 is a front view of the container, partially broken away to indicate constructional details.
Figure 6:
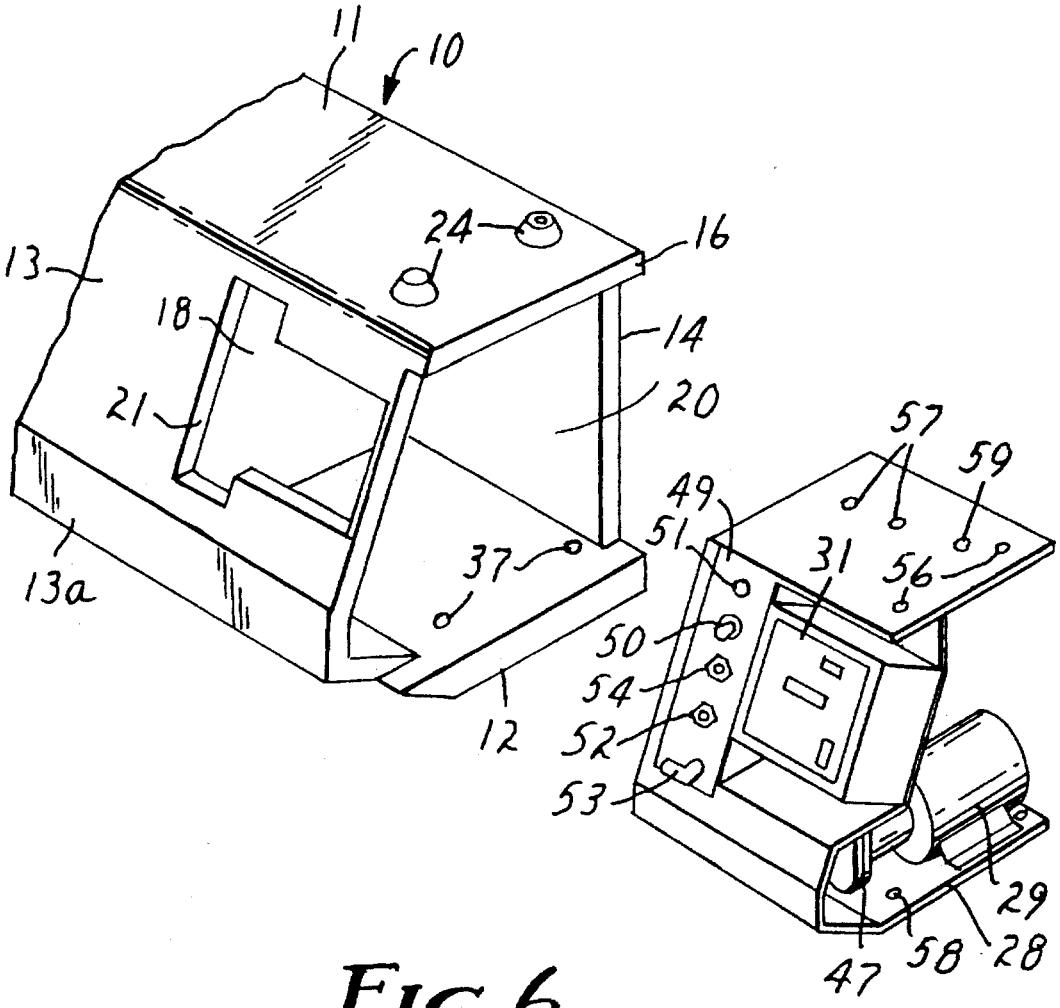
FIG. 6 is an exploded perspective view of the container, showing the control compartment and the chassis with equipment attached ready for insertion into the compartment.

As shown especially in FIGS. 4 and 5, intake hose 32 extends from the bottom of fluid compartment 19 through the upper portion of wall 18 into control compartment 20, where it leads to the input side of pump 29. Hose 34 extends from the output side of pump 29 to the input side of filter 34, and hose 35 extends from the output side of filter 34 to the input side of meter 31. Hose 36 extends from the output side of meter 31 to a connection for a delivery hose, as will be discussed subsequently in more detail. Filter 34 is attached to the upper portion of chassis 28 by means of bolts extending through holes 57. Two-stage filter 38 extends through hole 59 in chassis 28, through a comparable hole (not shown) in the upper portion of compartment 20, and into one of protuberances 24. Filter 38 provides for the removal of both particulate matter and water in the air that passes from the atmosphere into compartment 19 to relieve the vacuum caused as fluid is withdrawn from compartment 19. It may be desirable to provide filter 38 with a "spit valve" to provide for periodic draining of water removed. Check valve 39 minimizes the possibility that fluid in compartment 19 will contaminate filter 38.

Turning now to FIG. 3, where the electrical circuitry for the dispensing equipment is shown, quick disconnect female electrical outlet 27 is mounted in the rear wall of compartment 20. Wires 40 extend from outlet 27 to timer box 41, from which wires 42 extend to compartment light 43, wires wires 44 extend to pump 29, and wires 45 extend to on-off switch 50. Another pair of wires 46 extend from pump 29 to pressure switch 47. As shown in FIGS. 1 and 4, and indicated in FIG. 6, control panel 49 and meter 31 are positioned in opening 18 of upper front panel 13. Mounted on control panel 49 are on-off switch 50, indicator light 51, quick disconnect coupling 52 for filling compartment 19 with fluid, coupling 53 for attachment of a fluid delivery hose, and poppet valve 54 for relieving pressure when compartment 19 is being filled with fluid through coupling 52. When fluid is to be dispensed from compartment 19, one end of a delivery hose is connected to coupling 53 and the other end to a coupling on the container or the aircraft system to which fluid is to be dispensed. For convenience of users and to avoid confusion, identity plate 48 is mounted on upper front panel 13. Meter 31 shows the mount of fluid that has been dispensed.

To operate the equipment, a source of power (typically from the battery of the equipment on which container 10 is mounted) is connected to plug 27, and a delivery hose is connected to coupling 53. Switch 50 is then operated to turn on the power to the electrical dispensing equipment, indicator light 41 showing whether the switch is in the "on" or the "off" position and compartment light 42 illuminating the interior of compartment 20. Pump 29 then withdraws fluid from compartment 19 through intake hose 32 and successively through hose 34, filter 30, hose 35, meter 31, and coupling 53. As fluid is being withdrawn, air enters compartment 19 through two-stage filter 38.

Turning to FIGS. 4 and 5, intake hose 32 extends into the fluid in compartment 19 and is connected, through pressure relief valve 33, to the input side of pump 29. Hose 23 extends from the output side of pump 29 to the input side of filter 30, and hose 25 extends from the output side of filter 30 to the input side of meter 31. Hose 27 extends from the output side of meter 31 to the outer front wall of compartment 20, extending through plate 49 and becoming integral with coupling 54, to which delivery hose 53 may be attached. Indicator light 51 provides a reminder to shut off the equipment when it is not in use and thus to minimize drain on the battery that supplies power to the equipment. To further minimize such battery drain, timer box 41 is adjusted to shut down the system at any time that it has been turned on but has not been dispensing fluid for a predetermined amount of time, e.g., 20 minutes. As an additional means to prevent battery drain, pressure switch 47 shuts off current to pump 29 when pressure in hoses 32, 35, 36, and 37 builds up to a predetermined value, indicating that fluid is no longer being dispensed. It has been found eminently satisfactory to form tank 10 from linear high density polyethylene, which is relatively inexpensive, highly resistant to even corrosive fluids, and capable of enduring extremes in ambient temperature without softening, leaking, or embrittling. If extremely high ambient temperatures are to be encountered, it may be desirable to crosslink the polyethylene; doing so, however, is believed to preclude the possibility of recycling the container. To develop a product having the configuration of container 10, polyethylene powder can be placed in an appropriately sized and shaped rotary mold, which is thereafter heated and rotated. Other suitable polymers could be used in place of the high density polyethylene, bearing in mind the structural and environmental requirements and realizing that if the fluid attacks the wall of chamber 11, it not only weakens the wall but also incorporates dissolved material in the highly sensitive fluid and causes serious problems.

Although the invention has been described with particularity as a container for aircraft hydraulic fluid and engine oil, it will be recognized that it could also be used as a container for any fluid that is to be dispensed, including such environmentally hazardous fluids as herbicides, acids, ketones, alcohols, cleaning chemicals, and oils. It goes without saying that the invention could also be used in connection with transportation vehicles other than aircraft. Similarly, although the invention lends itself to use as a portable containing and dispensing system, tanks of the invention could also be mounted in a permanent location, e.g., on the wall of a hangar. The invention could also be used for supplying oils or fluids for use on a production line, to service equipment, etc.

What is claimed is as follows:

1. A stackable container for holding and dispensing fluid, comprising in combination a durable, corrosion-resistant polymeric container that is generally rectangularly parallelepipedal in shape, having flat upper and lower surfaces, the longest dimension of the container extending parallel to the ground to enhance stability, said container being divided into a first compartment for containing fluid to be dispensed and a second compartment enclosing dispensing equipment, said dispensing equipment being mounted on a chassis that can be readily installed in and removed from the second compartment.

2. The container of claim 1 wherein the container is formed of high density polyethylene.

3. The container of claim 1 wherein the upper and lower surfaces of the container are provided with mating protuberances and recesses to enhance stability when such containers are stacked.

4. The container of claim 3 wherein the compartment that encloses the dispensing equipment is located at one end of the container and is protectively covered by a door.

5. The container of claim 4 wherein the dispensing equipment comprises an electrically driven pump for transporting fluid from the compartment in which it is contained through a dispensing line to a fitting on the outside of the container.

6. The container of claim 5 wherein the dispensing line includes a filter and a meter.

7. The container of claim 6 wherein the dispensing equipment includes electrical circuitry for transmitting current to the pump from an exterior power source.

8. The container of claim 7 wherein the electrical circuitry includes an on-off switch located on the outside of the container.

9. The container of claim 7 wherein the electrical circuitry also includes a timer for cutting off electrical power after a predetermined time of inactivity.

10. The container of claim 9 wherein the electrical circuitry also includes a pressure switch for cutting off electrical power after a predetermined pressure has been reached in the dispensing line.

11. The container of claim 10 wherein the electrical circuitry includes a female outlet in a wall of the compartment enclosing the dispensing equipment.

12. The container of claim 11 wherein the upper front corner of the container is beveled to provide a convenient and readily visually accessible control panel for displaying the on-off switch and meter.

13. The container of claim 12 wherein a two-stage filter, capable of removing both moisture and particulate matter entrained in the air, is mounted in a wall of the fluid-containing compartment for venting purposes.

14. The container of claim 12 wherein the control panel also presents an indicator light, a coupling for filling the fluid compartment, a coupling for connecting a delivery hose, and a valve to release pressure when filling the fluid-containing compartment.

* * * * *